US010002604B2

(12) United States Patent
Kayama et al.

(10) Patent No.: US 10,002,604 B2
(45) Date of Patent: Jun. 19, 2018

(54) VOICE SYNTHESIZING METHOD AND VOICE SYNTHESIZING APPARATUS

(71) Applicant: Yamaha Corporation, Hamamatsu-Shi, Shizuoka-Ken (JP)

(72) Inventors: Hiraku Kayama, Hamamatsu (JP); Yoshiki Nishitani, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days. days.

(21) Appl. No.: 14/080,660

(22) Filed: Nov. 14, 2013

(65) Prior Publication Data

US 2014/0136207 A1 May 15, 2014

(30) Foreign Application Priority Data

Nov. 14, 2012 (JP) ..... 2012-250438

(51) Int. Cl.
*G10L 13/00* (2006.01)
*G10L 13/08* (2013.01)
(Continued)

(52) U.S. Cl.
CPC ..... *G10L 13/08* (2013.01); *G10H 1/02* (2013.01); *G10H 1/0551* (2013.01);
(Continued)

(58) Field of Classification Search
CPC ..... G10H 1/186; G10H 1/18; G10H 1/057; G10H 1/00; G10H 1/34; G10H 1/38;
(Continued)

(56) References Cited

U.S. PATENT DOCUMENTS 4,945,557 A * 7/1990 Kaneuchi ..... H04M 1/274566 379/354
5,290,964 A * 3/1994 Hiyoshi et al. ..... 84/600
(Continued)

FOREIGN PATENT DOCUMENTS

CN 1870130 A 11/2006
CN 102479508 A 5/2012
(Continued)

OTHER PUBLICATIONS

European Search Report dated Mar. 11, 2014, for EP Application No. 13192421.9, ten pages.
(Continued)

*Primary Examiner* — Michael Ortiz Sanchez
(74) *Attorney, Agent, or Firm* — Morrison & Foerster LLP

(57) ABSTRACT

A voice synthesizing apparatus includes a first receiver configured to receive first utterance control information generated by detecting a start of a manipulation on a manipulating member by a user, a first synthesizer configured to synthesize, in response to a reception of the first utterance control information, a first voice corresponding to a first phoneme in a phoneme sequence of a voice to be synthesized to output the first voice, a second receiver configured to receive second utterance control information generated by detecting a completion of the manipulation on the manipulating member or a manipulation on a different manipulating member, and a second synthesizer configured to synthesize, in response to a reception of the second utterance control information, a second voice including at least the first phoneme and a succeeding phoneme being subsequent to the first phoneme of the voice to be synthesized to output the second voice.

21 Claims, 5 Drawing Sheets

(51) Int. Cl.

| | |
|---|---|
| ***G10L 13/04*** | (2013.01) |
| ***G10H 1/02*** | (2006.01) |
| ***G10H 1/055*** | (2006.01) |
| ***G10H 1/34*** | (2006.01) |

(52) U.S. Cl.
CPC ..... *G10H 1/344* (2013.01); *G10L 13/04* (2013.01); *G10H 2220/271* (2013.01); *G10H 2230/135* (2013.01); *G10H 2230/155* (2013.01); *G10H 2230/251* (2013.01); *G10H 2240/311* (2013.01); *G10H 2250/455* (2013.01)

(58) Field of Classification Search
CPC . G10H 1/32; G10H 1/02; G10L 13/06; G10L 13/00; G10L 13/027; G10L 13/033; G10L 13/0335; G10L 13/04; H04L 67/125; H04L 67/34; H04L 41/0813; H04L 41/12; H04L 67/303; H04L 65/4084; H04L 67/02; H04L 67/06; G10C 3/12
USPC ..... 704/258–269, 272, 278; 84/653, 678, 84/744
See application file for complete search history.

(56) References Cited

U.S. PATENT DOCUMENTS

| | | | | |
|---|---|---|---|---|
| 5,311,175 | A * | 5/1994 | Waldman | G06F 3/023 341/22 |
| 5,875,427 | A * | 2/1999 | Yamazaki | G10L 21/06 704/258 |
| 5,883,327 | A * | 3/1999 | Terada et al. | 84/653 |
| 6,075,196 | A * | 6/2000 | Fujiwara | G10H 1/0066 84/13 |
| 6,163,769 | A | 12/2000 | Acero et al. | |
| 6,304,846 | B1 * | 10/2001 | George | G10L 13/033 704/205 |
| 7,124,084 | B2 | 10/2006 | Kayama et al. | |
| 2002/0166437 | A1 * | 11/2002 | Nishitani et al. | 84/600 |
| 2002/0184006 | A1 * | 12/2002 | Yoshioka | G10L 19/02 704/205 |
| 2002/0184032 | A1 * | 12/2002 | Hisaminato | G10L 13/06 704/268 |
| 2003/0004723 | A1 * | 1/2003 | Chihara | G10L 13/08 704/260 |
| 2003/0009336 | A1 * | 1/2003 | Kenmochi | G10L 13/07 704/258 |
| 2003/0009344 | A1 * | 1/2003 | Kayama | G10L 13/06 704/500 |
| 2004/0186720 | A1 * | 9/2004 | Kemmochi | G10H 5/00 704/258 |
| 2006/0085196 | A1 * | 4/2006 | Kayama et al. | 704/267 |
| 2006/0173676 | A1 * | 8/2006 | Kemmochi | G10L 13/06 704/207 |
| 2006/0271367 | A1 | 11/2006 | Hirabayashi et al. | |
| 2007/0214947 | A1 * | 9/2007 | Nishibori et al. | 84/744 |
| 2012/0136661 | A1 | 5/2012 | Fu et al. | |
| 2012/0143600 | A1 | 6/2012 | Iriyama | |
| 2012/0166197 | A1 | 6/2012 | Fu et al. | |
| 2014/0006031 | A1 * | 1/2014 | Mizuguchi | G10L 13/04 704/260 |
| 2014/0046667 | A1 * | 2/2014 | Yeom | G10L 13/033 704/258 |

FOREIGN PATENT DOCUMENTS

| | | | |
|---|---|---|---|
| CN | 102486921 | A | 6/2012 |
| EP | 0 396 141 | A2 | 11/1990 |
| EP | 1 675 101 | A2 | 6/2006 |
| JP | 3879402 | B2 | 11/2006 |
| JP | 2008-170592 | A | 7/2008 |

OTHER PUBLICATIONS

Moog, B. (May 1, 1986). "Musical Instrument Digital Interface," Journal of the Audio Engineering Society, vol. 34, No. 5, NY, USA, pp. 394-404.
Notification of Reasons for Refusal dated Feb. 10, 2015, for JP Application No. 2012-250438, with English translation, nine pages.
Chinese Search Report dated Mar. 2, 2016, for CN Application No. 201310572222.6, with English translation, four pages.
Notification of the First Office Action dated Mar. 2, 2016, for CN Application No. 201310572222.6, with English translation, seven pages.

* cited by examiner

VOICE SYNTHESIZING METHOD AND VOICE SYNTHESIZING APPARATUS

BACKGROUND

This disclosure relates to a voice synthesis technology, and more particularly, relates to a real-time voice synthesis technology.

A voice synthesis technology is widespread in which a voice signal representative of a guidance voice in a voice guidance, a literary work reading voice, a song singing voice or the like is synthesized by electric signal processing by use of a plurality of kinds of synthesis information. For example, in the case of the singing voice synthesis, as the synthesis information, musical expression information is used such as information representative of the pitches and durations of the musical notes constituting a melody of a song which is the object of singing voice synthesis and information representative of phoneme sequences of the lyrics uttered in time with the musical notes. In the case of synthesis of a voice signal of a guidance voice in a voice guidance or a literary work reading voice, information representative of the phonemes of the guidance sentence or the sentence of the literary work and information representative of change of prosody such as intonation and accent are used as the synthesis information. Conventionally, for the voice synthesis of this kind, a so-called batch processing method has been common in which various kinds of synthesis information related to the entire voice of the object of synthesis are all inputted to a voice synthesizing apparatus in advance and a voice signal representative of the voice waveform of the entire voice of the synthesis object is generated in one batch based on those pieces of synthesis information. However, in recent years, a real-time voice synthesis technology has also been proposed (see, for example, JP-B-3879402).

An example of the real-time voice synthesis is a technology of synthesizing a singing voice by previously inputting information representative of the phoneme sequence of the lyrics of the entire song to a singing voice synthesizing apparatus and sequentially specifying the pitch and the like in uttering the lyrics by operating a keyboard resembling a piano keyboard. In recent years, it has also been proposed to perform singing voice synthesis in units of musical notes by letting the user sequentially input, for each musical note, musical note information representative of the pitch and phoneme sequence information representative of the phoneme sequence of the portion of the lyrics uttered in time with the musical note by use of a singing voice synthesis keyboard where a phoneme information input portion in which manipulating members for inputting the phonemes (consonants and vowels) constituting the phoneme sequence of the lyrics are arranged and a musical note information input portion resembling a piano keyboard are arranged side by side.

When information representative of the phoneme sequence of the lyrics of the entire song is previously stored in a singing voice synthesizing apparatus to perform real-time singing voice synthesis, a faltering unnatural singing voice as if the lyrics were uttered with a delay from the musical score is sometimes synthesized. The reason that such a falter occurs is as follows:

FIG. 5A is a view showing an example of the utterance timing of each phoneme when a person sings a portion of lyrics constituted by a consonant and a vowel in time with a musical note. In FIG. 5A, the musical note is represented by a rectangle N shown on the staff, and the portion of the lyrics sung in time with the musical note is shown in the rectangle. As shown in FIG. 5A, when a person sings a portion of lyrics constituted by a consonant and a vowel in time with a musical note, it is typical that the person starts the utterance of the portion at time T0 preceding time T1 corresponding to the utterance timing on the musical score (symbol # in FIGS. 5A and 5B represents a silence; the same applies in FIG. 3.) and utters the boundary part between the consonant and the vowel at time T1.

Likewise, in the real-time singing voice synthesis using a keyboard resembling a piano keyboard, as shown in FIG. 5B, it is common that the user starts to depress a key K for specifying the pitch with a finger F at time T0 preceding the position of the musical note on the musical score and fully depresses the key K at time T1. However, since this kind of keyboard is generally structured so as to output information representative of the pitch (or to output information representative of the pitch and information representative of the velocity corresponding to the key depression speed) at the point of time when the key is fully depressed, it is at the time when the key is fully depressed (time T1) that the information representative of the pitch is actually outputted. On the other hand, in the singing voice synthesizing apparatus, singing voice synthesis is not started until both the phoneme sequence information and the information representative of the pitch are acquired. Even if the time required for the synthesis processing is short enough to be ignored, it is at time T1 that the output of the singing voice is started, and the time lag (T1-T0) between when the key K is started to be depressed and when it is fully depressed appears as the above-mentioned falter. The same occurs when singing voice synthesis is performed by letting the user sequentially input a portion of the lyrics and the pitch for each musical note and when synthesis of a guidance voice or a reading voice is performed.

The present disclosure is made in view of the above-mentioned problem, and an object thereof is to provide a technology of enabling real-time synthesis of an unfaltering natural voice.

SUMMARY

In order to achieve the above object, according to the present disclosure, there is provided a voice synthesizing method comprising:

a first receiving step of receiving first utterance control information generated by detecting a start of a manipulation on a manipulating member by a user;

a first synthesizing step of synthesizing, in response to a reception of the first utterance control information, a first voice corresponding to a first phoneme in a phoneme sequence of a voice to be synthesized to output the first voice;

a second receiving step of receiving second utterance control information generated by detecting a completion of the manipulation on the manipulating member or a manipulation on a different manipulating member; and a second synthesizing step of synthesizing, in response to a reception of the second utterance control information, a second voice including at least the first phoneme and a succeeding phoneme being subsequent to the first phoneme of the voice to be synthesized to output the second voice.

As examples of voice output in response to the reception of the second utterance control information, the following are considered: a first example that a voice of the part succeeding the part of transition from the first phoneme to the succeeding phoneme in the phoneme sequence represented by the phoneme sequence information is synthesized and outputted; and a second example that a voice of repetitively uttering the transition part (or a voice of repetitively uttering the transition part with one or more than one silence in between) or a voice of continuously uttering the transition part is synthesized and outputted.

According to the above voice synthesizing method, the output of a voice of the part of transition from the silence to the first phoneme (for example, the part of transition from a silence to a consonant s in starting to sing "さいた [saita]" from silent state) is started in response to the start of a manipulation on the manipulating member to let the user provide an instruction to start voice utterance, so that the time lag between the start of the manipulation on the manipulating member and the start of utterance of the synthetic voice is substantially eliminated and an unfaltering voice can be synthesized in real time. Likewise, for the synthesis of the voice of a portion "た (ta)" of "さいた (saita)", the output of the voice of the part of transition from the preceding phoneme (in this example, the vowel i) to the first phoneme (in this example, the consonant t) represented by the phoneme sequence information of the portion is started in response to the start of the manipulation on the manipulating member to let the user provide an instruction to start utterance, so that the time lag between the start of the manipulation on the manipulating member and the start of utterance of the synthetic voice is substantially eliminated and an unfaltering voice is synthesized. The output timing of the part of transition from the first phoneme to the succeeding phoneme (in the case of a portion of the lyrics constituted by a consonant and a vowel, the part of transition from the consonant to the vowel) can be adjusted by the completion of the manipulation on the manipulating member (for example, completely (full) depression of the manipulating member) or a manipulation on a different manipulating member, so that a natural singing voice accurately reproducing human singing characteristics can be synthesized. When the phoneme sequence information represents one phoneme (for example, a vowel), voice synthesis may be performed in response to the reception of the first utterance control information, or voice synthesis may be performed after the reception of the second utterance control information.

BRIEF DESCRIPTION OF THE DRAWINGS

The above objects and advantages of the present disclosure will become more apparent by describing in detail preferred exemplary embodiments thereof with reference to the accompanying drawings, wherein.

DETAILED DESCRIPTION OF EXEMPLARY EMBODIMENTS

Hereinafter, an embodiment of the present disclosure will be described.

(A: Embodiment)

Figure 1:
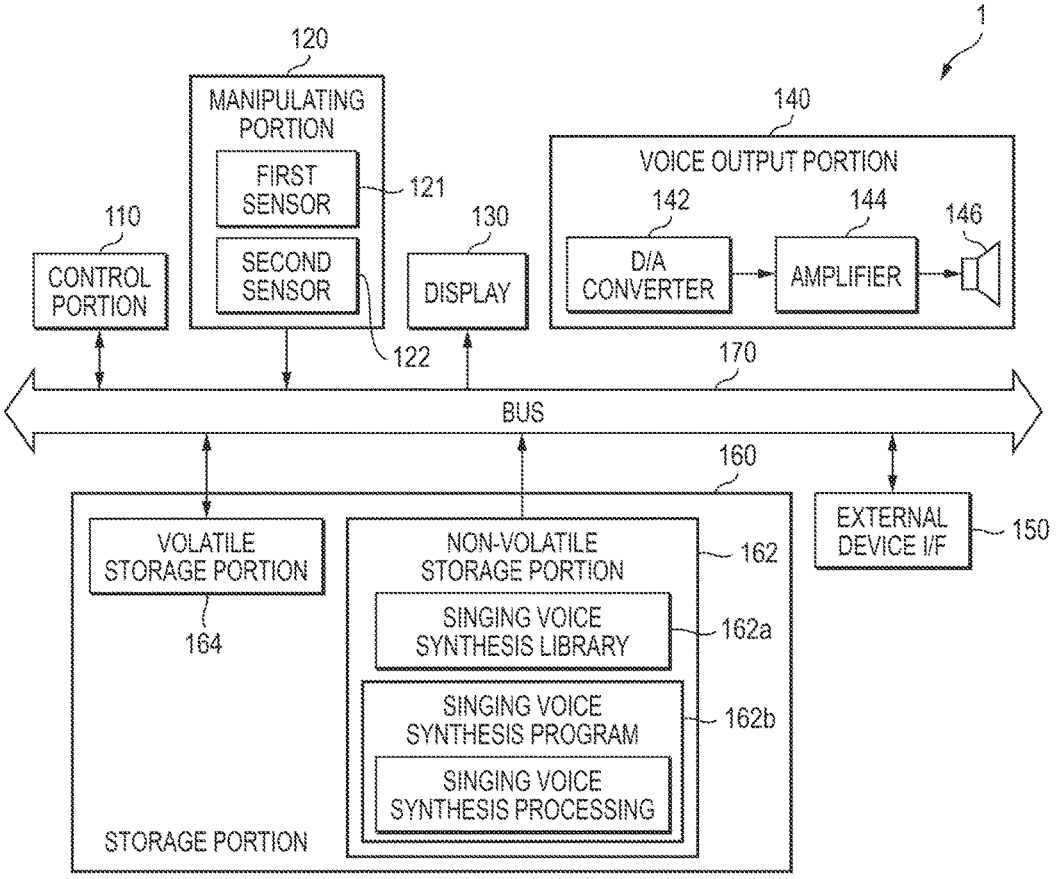
FIG. 1 is a view showing a configuration example of a singing voice synthesizing apparatus of an embodiment of the disclosure.

FIG. 1 is a block diagram showing a configuration example of a singing voice synthesizing apparatus 1 as an embodiment of the voice synthesizing apparatus of the present disclosure. This singing voice synthesizing apparatus 1 is an apparatus that performs real-time singing voice synthesis by letting the user sequentially input a plurality of kinds of synthesis information (the phoneme sequence information representative of the phoneme sequence of the lyrics uttered in time with the musical notes, the information representative of the pitch of the musical note, etc.) and using those pieces of synthesis information. As shown in FIG. 1, the singing voice synthesizing apparatus 1 includes a control portion 110, an manipulating portion 120, a display 130, a voice output portion 140, an external device interface (hereinafter, abbreviated as "I/F") portion 150, a storage portion 160, and a bus 170 that mediates data reception and transmission among these elements.

The control portion 110 is, for example, a CPU (central processing unit). The control portion 110 operates according to a singing voice synthesis program stored in the storage portion 160, thereby functioning as the voice synthesis unit for synthesizing a singing voice based on the above-mentioned plurality of kinds of synthesis information. Details of the processing that the control portion 110 executes according to the singing voice synthesis program will be clarified later. While a CPU is used as the control portion 110 in the present embodiment, it is to be noted that a DSP (digital signal processor) may be used.

The manipulating portion 120 is the above-described singing voice synthesis keyboard, and has a phoneme information input portion and a musical note information input portion. By operating the manipulating portion 120, the user of the singing voice synthesizing apparatus 1 can specify a musical note included in a melody of the song which is the object of singing voice synthesis and the phoneme sequence of the portion of the lyrics uttered in time with the musical note. For example, when "さ (sa)" of the lyrics is specified, of a plurality of manipulating members provided on the phoneme information input portion, a manipulating member corresponding to the consonant "s" and a manipulating member corresponding to the vowel "a" are successively depressed, and when "C4" is specified as the pitch of the musical note corresponding to the portion of the lyrics, of a plurality of manipulating members (keys) provided on the musical note information input portion, the key corresponding to the pitch is depressed to specify the start of the utterance thereof and the finger is moved away from the key to specify the end of the utterance. That is, the length of the time during which the key is depressed is the duration of the musical note. Moreover, by the speed of depression of the key corresponding to the musical note, the user can specify the intensity (velocity) of the voice when a portion of the lyrics is uttered in time with the musical note. As the arrangement that enables the specification of the velocity by the key depression speed, an arrangement in the related electronic keyboard instruments is adopted.

When an operation of specifying a phoneme sequence is performed, the phoneme information input portion (not shown in FIG. 1) of the manipulating portion 120 supplies the control portion 110 with phoneme sequence information representative of the phoneme sequence. On the other hand, the musical note information input portion of the manipulating portion 120 includes, for each manipulating member to specify the pitch (in the present embodiment, a manipulating member resembling a key of a piano keyboard), a first sensor 121 to detect the start of depression of a manipulating member and a second sensor 122 to detect that the manipulating member has been fully depressed. As the first and second sensors 121, 122, various types of sensors such as mechanical sensors, pressure-sensitive sensors or optical sensors may be used. It is essential only that the first sensor 121 be a sensor to detect that the key has been depressed to a depth exceeding a predetermined threshold value and the second sensor 122 be a sensor to detect that the key has been fully depressed.

For example, a two-make switch can be employed as the first sensor and the second sensor. One example of the two-make switch is disclosed in U.S. Pat. No. 5,883,327. In FIG. 1A of U.S. Pat. No. 5,883,327. contacts 9, 11 correspond to the first sensor and contacts 10, 12 correspond to the second sensor.

When detecting the start of depression of a key by the first sensor 121, the musical note information input portion of the manipulating portion 120 supplies the control portion 110 with a note-on event (MIDI [musical instrument digital interface] event) including pitch information (for example, the note number) representative of the pitch corresponding to the key as first utterance control information to provide an instruction to start utterance. When detecting by the second sensor 122 a full depression of the manipulating member the start of depression of which has been detected by the first sensor 121, the musical note information input portion supplies the control portion 110 with a note-on event including the pitch information corresponding to the key and the value of the velocity corresponding to the length of the time required from the detection of the start of depression by the first sensor 121 to the detection of the full depression by the second sensor 122, as second utterance control information. Then, when detecting the return from the completely depressed position by the second sensor 122, the musical note information input portion supplies the control portion 110 with third utterance control information to provide an instruction to stop utterance (in the present embodiment, note-off event). The information included in the second utterance control information is not limited to the information to specify the intensity of utterance (velocity); it may be information to specify the volume or may be both the velocity and the volume.

The display 130 is, for example, a liquid crystal display and a driving circuit thereof, and displays various images such as a menu image to prompt the use of the singing voice synthesizing apparatus 1 under the control of the control portion 110. The voice output portion 140 includes, as shown in FIG. 1, a D/A converter 142, an amplifier 144 and a speaker 146. The D/A converter 142 D/A converts the digital voice data (voice data representative of the voice waveform of the synthetic singing voice) supplied from the control portion 110, and supplies the resultant analog voice signal to the amplifier 144. The amplifier 144 amplifies the level (that is, the volume) of the voice signal supplied from the D/A converter 142 to a level suitable for speaker driving, and supplies the resultant signal to the speaker 146. The speaker 146 outputs the voice signal supplied from the amplifier 144 as a voice.

The external device I/F portion 150 is an aggregate of interfaces such as a USB (universal serial bus) interface and an audio interface for connecting other external devices to the singing voice synthesizing apparatus 1. While a case where the singing voice synthesis keyboard (the manipulating portion 120) and the voice output portion 140 are elements of the singing voice synthesizing apparatus 1 is described in the present embodiment, it is to be noted that the singing voice synthesis keyboard and the voice output portion 140 may be external devices connected to the external device I/F portion 150.

The storage portion 160 includes a non-volatile storage portion 162 and a volatile storage portion 164. The non-volatile storage portion 162 is formed of a non-volatile memory such as a ROM (read only memory), a flash memory or a hard disk, and the volatile storage portion 164 is formed of a volatile memory such as a RAM (random access memory). The volatile storage portion 164 is used by the control portion 110 as the work area for executing various programs. On the other hand, the non-volatile storage portion 162 previously stores, as shown in FIG. 1, a singing voice synthesis library 162*a* and a singing voice synthesis program 162*b*.

The singing voice synthesis library 162*a* is a database storing fragment data representative of the voice waveforms of various phonemes and diphones (transition from a phoneme to a different phoneme [including silence]). The singing voice synthesis library 162*a* may be a database storing fragment data of triphones in addition to monophones and diphones or may be a database storing the stationary parts of the phonemes of the voice waveforms and parts of transition to other phonemes (transient parts). The singing voice synthesis program 162*b* is a program for causing the control portion 110 to execute singing voice synthesis using the singing voice synthesis library 162*a*. The control portion 110 operating according to the singing voice synthesis program 162*b* executes singing voice synthesis processing.

The singing voice synthesis processing is processing of synthesizing voice data representative of the voice waveform of a singing voice based on a plurality of kinds of synthesis information (the phoneme sequence information, the pitch information, the information representative of the velocity and volume of a voice, etc.) and outputting the voice data.

Figure 2:
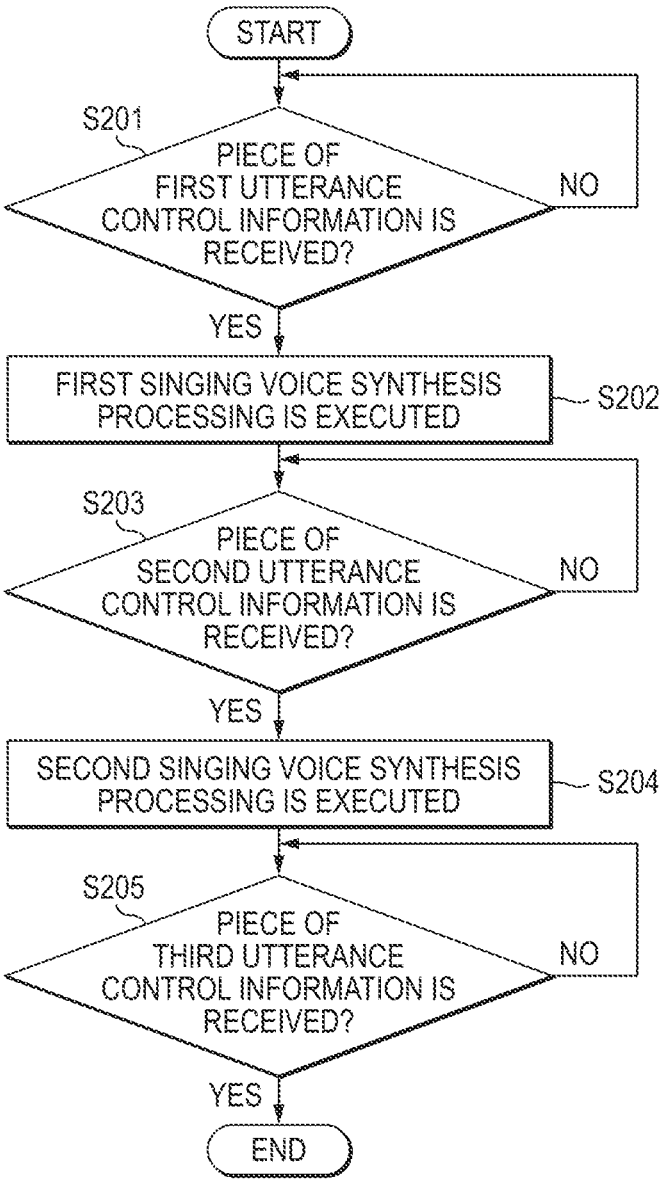
FIG. 2 is a view showing a flowchart for explaining an example of a singing voice synthesizing process according to the embodiment of the disclosure.

An explanation regarding an example of a singing voice synthesizing process will be described by referring to FIG. 2. In FIG. 2, at a step S201, it is determined that whether the control portion 110 receives both of phoneme sequence information and the piece of first utterance control information. If the control portion 110 (first receiver) receives both of phoneme sequence information and the piece of first utterance control information at the step S201, a process proceeds to a step S202, and then a first singing voice synthesis processing is started in response to a reception of the piece of first utterance control information by the control portion 110 (first synthesizer). If the control portion 110 has not received both of the phoneme sequence information and the piece of first utterance control information at the step S201, the control portion 110 waits for receiving both of the phoneme sequence information and the piece of first utterance control information. In this first singing voice synthesis processing, the control portion 110 reads from the singing voice synthesis library 162*a* the fragment data corresponding to the part of transition from a silence or the phoneme of the preceding portion of the lyrics to the first phoneme in the phoneme sequence represented by the phoneme sequence information, performs signal processing to the fragment data such as pitch conversion so that the pitch is matched with the one represented by the pitch information included in the piece of first utterance control information to thereby synthesize voice waveform data of the transition part, and supplies the result voice waveform data to the voice output portion 140.

Thereafter, at a step S203, it is determined that whether the control portion 110 receives the piece of second utterance control information. If the control portion 110 (second receiver) receives the piece of second utterance control information at the step S203, a process proceeds to a step S204, and then a second singing voice synthesis processing is started in response to a reception of the piece of second utterance control information by the control portion 110 (second synthesizer). If the control portion 110 has not received the piece of second utterance control information at the step S203, the control portion 110 waits for receiving the piece of second utterance control information. In this second singing voice synthesis processing, the control portion 110 reads from the singing voice synthesis library 162*a* the pieces of fragment data of the phonemes succeeding the part of transition from the first phoneme to the succeeding phoneme, synthesizes the voice waveform data of the part succeeding the transition part by combining the pieces of fragment data by performing signal processing to the pieces of fragment data of the phonemes such as processing of converting the pitch so that the pitch is matched with the one represented by the pitch information included in the first utterance control information and the adjustment of the attack depth (lessening at a rising waveform) according to the value of the velocity included in the piece of second utterance control information, and supplies the result voice waveform data to the voice output portion 140.

At a step S205, it is determined that whether the control portion 110 receives a piece of third utterance control information. If the control portion 110 receives the piece of third utterance control information at the step S205, in response to the reception of the third utterance control information, the control portion 110 ends the singing voice synthesis processing, and stops the output of the synthetic singing voice. If the control portion 110 has not received the piece of third utterance control information at the step S205, the control portion 110 waits for receiving the piece of third utterance control information.

For example, when a singing voice starting to sing "さいた (saita)" from silent state is synthesized, for the singing voice of a portion "さ (sa)", the output of the voice of the part of transition from a silence to the first phoneme (the consonant s) represented by the phoneme sequence information of the lyrics is started in response to the start of the manipulation on the manipulating member to provide an instruction to start utterance, and the output of the voice of the part succeeding the part of transition from the first phoneme to the succeeding phoneme (the vowel a) is started in response to the full depression of the manipulating member. This substantially eliminates the time lag between the start of the manipulation on the manipulating member and the start of utterance of the synthetic voice, which makes it possible to synthesize an unfaltering voice in real time. Likewise, for the singing voice of a portion "た (ta)" of "さいた (saita)", the output of the voice of the part of transition from the preceding phoneme (in this example, the vowel i) to the first phoneme represented by the phoneme sequence information of the portion (in this example, the consonant t) is started in response to the start of the manipulation on the manipulating member to provide an instruction to start utterance, and the output of the voice of the part succeeding the part of transition from the first phoneme to the succeeding phoneme (the vowel a) is started in response to the full depression of the manipulating member. When the phoneme sequence information represents one vowel, singing voice synthesis may be started in response to the receptions of both the phoneme sequence information and the piece of first utterance control information by the control portion 110, or singing voice synthesis may be started after the reception of the piece of second utterance control information. In the latter mode, singing voice synthesis is performed with a voice intensity represented by the velocity included in the piece of second utterance control information, and in the former mode, singing voice synthesis is started with a predetermined default velocity and in response to the reception of the piece of second utterance control information, the velocity is changed so as to be a value corresponding to the velocity included in the piece of second utterance control information. Moreover, switching between the former mode and the latter mode may be made according to the user's selection.

When the first phoneme of the phoneme sequence represented by the phoneme sequence information is an unsustainable voice (for example, a plosive), the processing of repeating the output of the phoneme until the second utterance control information is received may be executed by the control portion 110, or the output of the phoneme is repeated with one or more than one silence in between so that the phoneme does not succeed such as repeating "the phoneme and a silence", repeating "a silence, the phoneme and a silence" or repeating "a silence and the phoneme". In a mode where an apparatus having a musical performance function in addition to the singing voice synthesis function is used as the singing voice synthesizing apparatus 1, when the first and the second utterance control information is inputted without any phoneme sequence information, instead of the singing voice synthesis output, the processing of outputting a musical performance sound by the musical performance function is executed by the control portion 110. Moreover, when no succeeding portion of the lyrics is inputted like when the portion succeeding the first portion "さ (sa)" is not inputted in a case where a singing voice starting to sing with "さいた (saita)" from silent state is synthesized, the processing of synthesizing and outputting a voice of repetitively uttering the part of transition from the first phoneme (the consonant s) to the succeeding phoneme (the vowel a) in the phoneme sequence representing the portion of the lyric (or a voice of repetitively uttering the transition part with one or more than one silence in between) and a voice of continuously uttering the transition part may be executed by the control portion 110 in response to the full depression of the manipulating member to provide an instruction to start utterance. It is essential only that a voice including at least the part of transition from the first phoneme to the succeeding phoneme in the phoneme sequence represented by the phoneme sequence information is synthesized and outputted in response to the reception of the second utterance control information.

Figure 3:
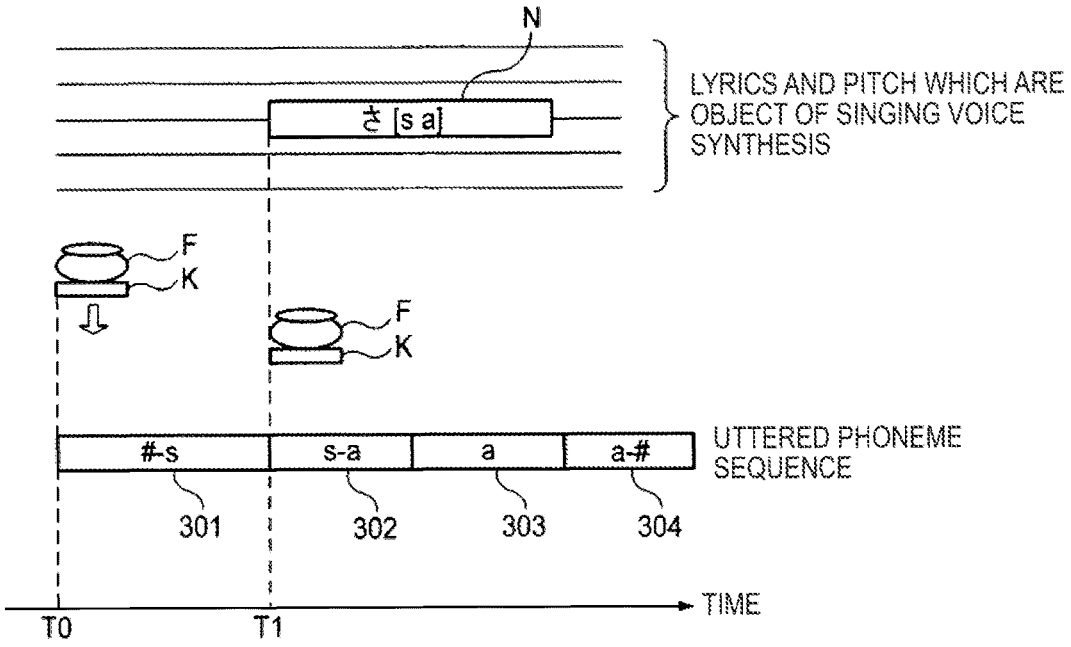
FIG. 3 is a view for explaining an operation of the singing voice synthesizing apparatus 1.

In the present embodiment, as shown in FIG. 3, the output of the synthetic singing voice is started at the operation start time (time T0) of the manipulating member to specify the pitch, and an unfaltering singing voice can be synthesized. Here, of the fragment data stored in the singing voice synthesis library 162*a*, the fragment data representative of the voice waveform of the part of transition from a consonant to a vowel is, for example, structured so that the length of the consonant portion is minimized. This is because by structuring the fragment data of the part of transition from a consonant to a vowel so that the consonant portion is minimized, the time lag between the time when the manipulating member to specify the pitch is fully depressed (time T1) and the time of utterance of the vowel can be minimized and this enables synthesis of a singing voice closer to human singing.

Moreover, by using a sensor to detect that the user's finger has touched the manipulating member (for example, a capacitance sensor) as the first sensor 121 to detect the start of a manipulation on the manipulating member of the musical note information input portion, the synthesis of the voice of the part of transition from a silence or the phoneme of the preceding portion of the lyrics to the first phoneme in the phoneme sequence represented by the phoneme sequence information can be started before the manipulation on the manipulating member to specify the pitch is actually started, so that the delay until the start of the output of the synthetic singing voice can be further reduced. In this mode, the following may be performed: In addition to the sensor to detect that the user's finger has touched the manipulating member, a sensor to detect that the depression of the manipulating member has been started is provided, singing voice synthesis is started in response to the detection output of the former sensor and the output of the synthetic singing voice is started in response to the detection output of the latter sensor.

Moreover, in the present embodiment, the second utterance control information is outputted in response to the full depression of the manipulating member of the musical note information input portion, and the third utterance control information to provide an instruction to stop utterance is outputted in response to the return from the completely depressed position. However, the third utterance control information may be supplied to the control portion 110 in response to the detection, by the first sensor 121, of the return to the position before the start of depression. According to this mode, it is made possible to measure the time required for the return from the completely depressed position to the position before the start of depression and use the length of the time for the control of vanishment of the singing voice being uttered (control of utterance of the released part), so that the expressive power of the singing voice can be further improved by the user performing an operation such as slowly moving the finger from the fully depressed manipulating member. Moreover, it may be performed to detect, by the second sensor 122, that a force is applied to the manipulating member so as to be further depressed from the completely depressed position (or a different sensor to detect the magnitude of the force), supply the control portion 110 with utterance control information corresponding to the magnitude of the force and perform utterance control according to the utterance control information.

It may be performed to switch between an operation mode to output the utterance control information in twice as in the present embodiment and an operation mode to output utterance control information including information representative of the pitch and information representative of the velocity (or the volume) according to an instruction from the user in response to the full depression of the key like the related electronic keyboard instruments. Moreover, the following may be performed: The velocity included in the second utterance control information is not used for the singing voice synthesis and the second utterance control information is used only for identifying the output timing of the part of transition from a consonant to a vowel. In this case, it is unnecessary that the velocity be included in the second utterance control information, and it is also unnecessary that the adjustment of the attack depth or the like be executed by the control portion 110.

Next, an explanation regarding another example of a singing voice synthesizing process will be described. In the phoneme information input portion, during a period from a start time of manipulating on a manipulating member to specify a pitch to a time where the manipulating member is depressed to a completely depressed position of the manipulating member, if a manipulation on one or more different manipulating members to specify another pitch is started, the control portion 110 successively receives a plurality of pieces of first utterance control information generated by the manipulation. In this example, a synthesis processing (first singing voice synthesis processing) of the voice of the part of transition from a silence or the phoneme of the preceding portion of the lyrics to the first phoneme in the phoneme sequence represented by the phoneme sequence information is executed by the control portion 110 by using the earliest one piece selected from among the plurality of pieces of first utterance control information. Also, a synthesis (a second singing voice synthesis processing) of the voice including at least the part of transition from the first phoneme to the succeeding phoneme is executed by the control portion 110 by selecting a piece of second utterance control information corresponding to the earliest piece of first utterance control information (the piece of second utterance control information including information representative of the pitch the same as that included in the earliest piece of first utterance control information) from among one or a plurality of pieces of second utterance control information received after the first singing voice synthesis processing is executed. In this example, the control portion 110 does not accept the one or the plurality of pieces of first utterance control information subsequent to the earliest piece of first utterance control information until the second singing voice synthesis processing is executed. By the above processing, even if during the period from the start time of manipulating on the manipulating member to specify the pitch to the time when the manipulating member is depressed to the completely depressed position of the manipulating member, the manipulation on the different manipulating member to specify another pitch is started and then the plurality of pieces of first utterance control information are successively received, the singing voice synthesis processing is executed by using the earliest piece of first utterance control information from among the received first utterance control information.

For example, in a case that after a start to manipulate a manipulating member corresponding to a pitch "C3", a manipulation to a different manipulating member corresponding to a pitch "D3" is started before the manipulating member corresponding to the pitch "C3" is completely depressed to a completely depressed position, the earliest piece of first utterance control information, that means, the piece of first utterance control information corresponding to the pitch "C3" is selected. Also, the piece of second utterance control information corresponding to the piece of selected first utterance control information is used for executing a singing voice synthesis processing. The piece of second utterance control information corresponds to the pitch "C3".

Figure 4:
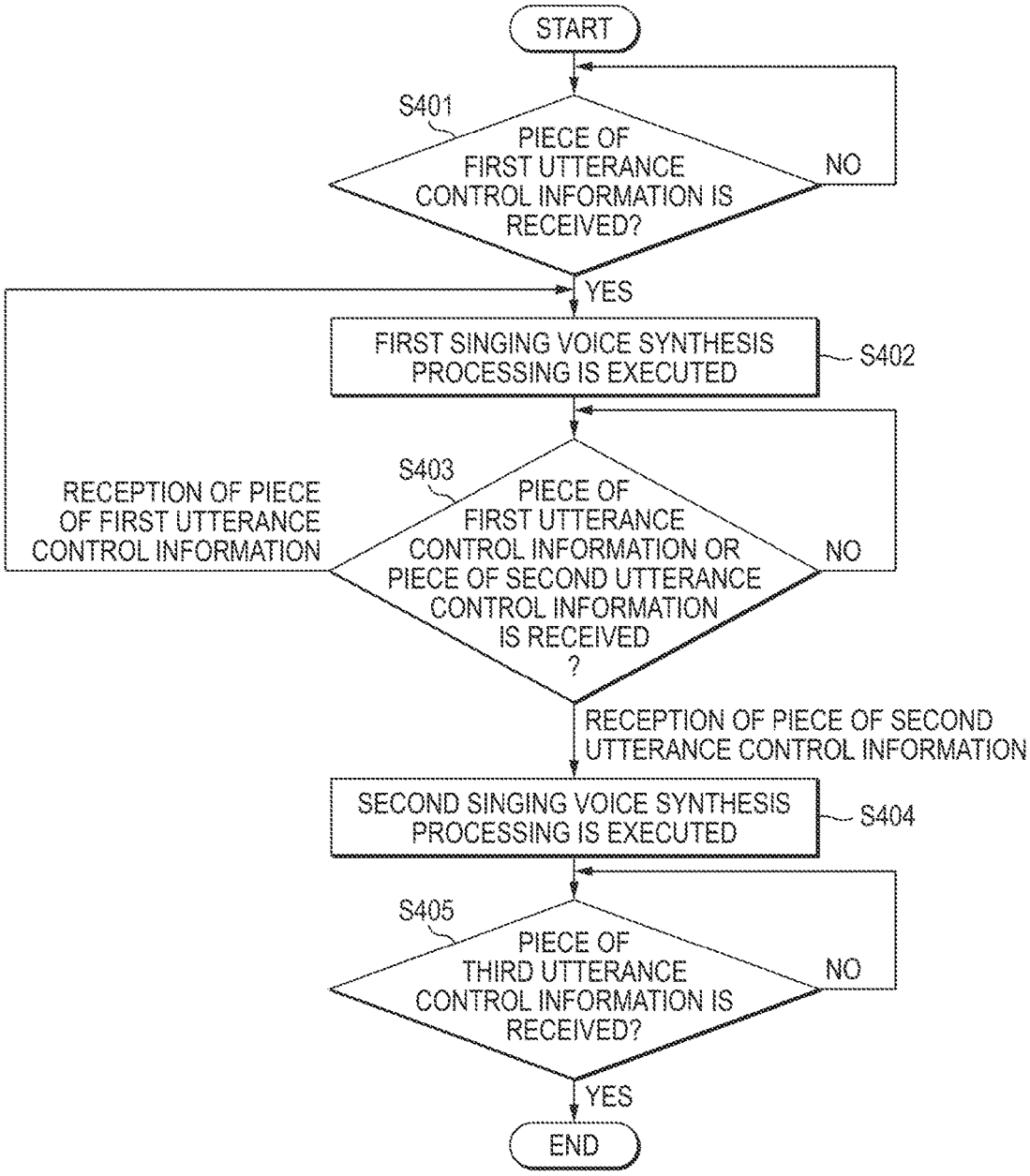
FIG. 4 is a view showing a flowchart for explaining another example of a singing voice synthesizing process according to the embodiment of the disclosure.
Figure 5A:
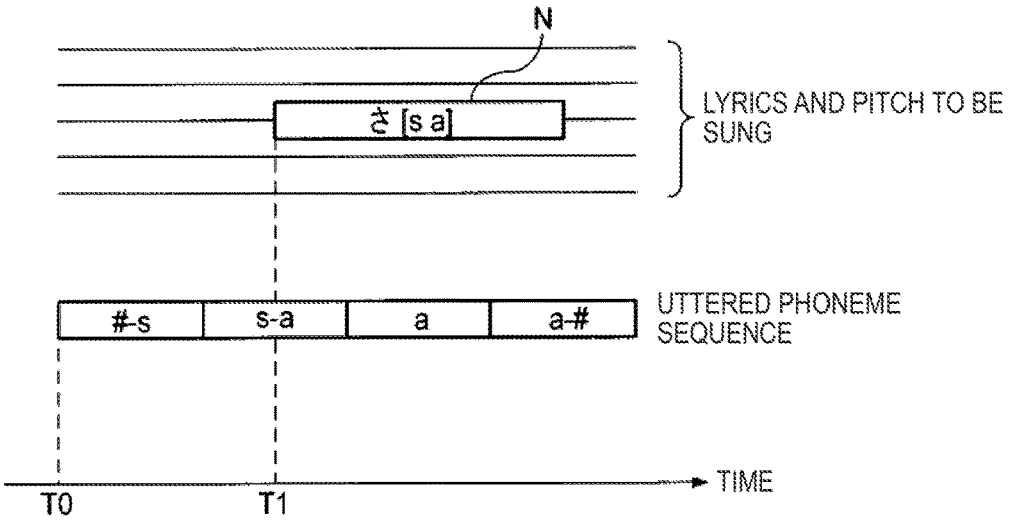
FIGS. 5A and 5B are views for explaining a problem of the related real-time singing voice synthesis technology.
Figure 5B:
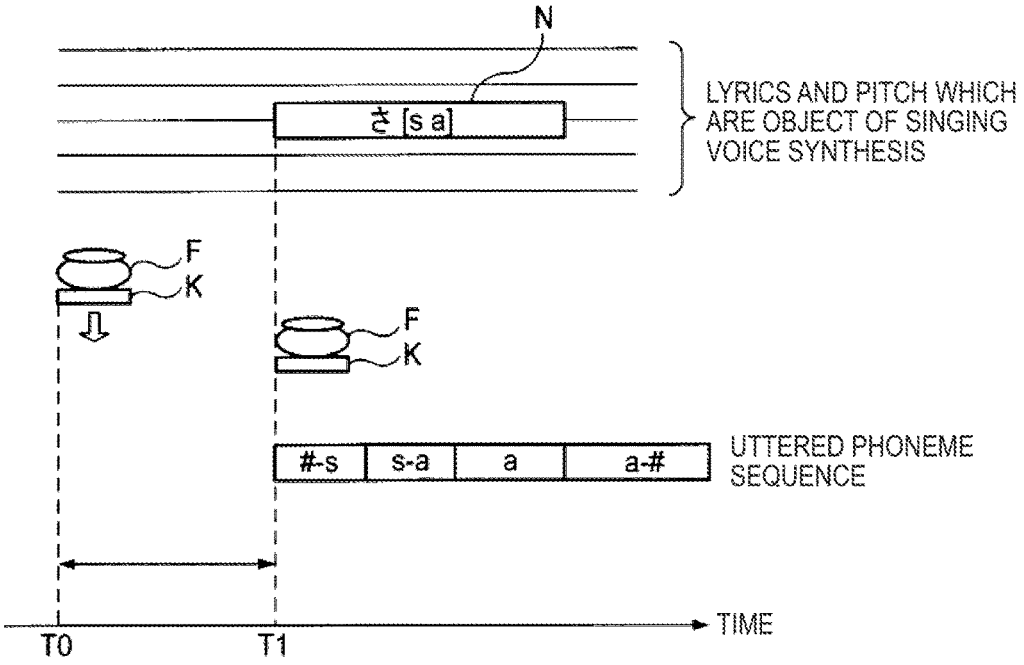

Next, an explanation regarding the other example of a singing voice synthesizing process will be described by referring to FIG. 4. In this example, a singing voice synthesizing process when receiving a piece of second utterance control information after successively receiving a plurality of pieces of first utterance control information will be described. In FIG. 4, at a step S401, it is determined that whether the control portion 110 receives both of phoneme sequence information and the piece of first utterance control information. If the control portion 110 has not received both of the phoneme sequence information and the piece of first utterance control information at a step S401, the control portion 110 waits for receiving both of the phoneme sequence information and the piece of first utterance control information. If the control portion 110 receives both of phoneme sequence information and the piece of first utterance control information at a step S401, a process proceeds to S402, and then the control portion 110 performs a synthesis processing (a first singing voice synthesis processing) of a voice including the transition part from a silence or the phoneme of the preceding portion of the lyrics to the first phoneme in the phoneme sequence represented by the phoneme sequence information in response to the reception of the piece of first utterance control information.

At a step S403, it is determined that whether (i) the control portion 110 receives the piece of first utterance control information, (ii) the control portion 110 receives the piece of second utterance control information, or (iii) the control portion 110 has not received both of the piece of first utterance control information and the piece of second utterance control information. If the control portion 110 receives the piece of first utterance control information at the step S403 (in a case of item (i) of step S403), a process is returned to the step S402, and then the control portion 110 performs a synthesis processing of the transition part from the silence or the phoneme of the preceding portion of the lyrics to the first phoneme in the phoneme sequence in response to the piece of first utterance control information received at the step S403. If the control portion 110 receives the piece of second utterance control information at the step S403 (in a case of item (ii) of step S403), a process proceeds to step S404, and then the control portion 110 performs a synthesis processing of a voice including at least a transition part from the first phoneme to a succeeding phoneme being subsequent to the first phoneme in response to the piece of second utterance control information received at the step S403.

If the control portion 110 has not received both of the piece of first utterance control information and the piece of second utterance control information at a step S403, the control portion 110 waits for receiving either the piece of first utterance control information or the piece of second utterance control information. An explanation of a process of a step S405 is omitted since the process of the step S405 is same as that of the step S205 in FIG. 2.

By the above processes, the singing voice synthesis processing of the part of transition from a silence or the phoneme of the preceding portion of the lyrics to the first phoneme in the phoneme sequence represented by the phoneme sequence information can be executed by selecting the piece of first utterance control information (that is, the last piece of first utterance control information), which is received immediately before the reception of the piece of the second utterance control information, from among the plurality of pieces of first utterance control information which are successively received.

According to this configuration, even when a plurality of pieces of first utterance control information are successively acquired by a correction of mis-depression such as mis-touching, a singing voice can be synthesized with the corrected pitch. In a mode that the piece of second utterance control information, which is received first after the reception of one or more pieces of first utterance control information is received from the manipulating portion 120, is always adopted, it is unnecessary that the information representative of the pitch is included in the piece of second utterance control information.

For example, in a case that after a start to manipulate a manipulating member corresponding to a pitch "C3", a manipulation to a different manipulating member corresponding to a pitch "D3" is started and then the different manipulating member is completely depressed to a completely depressed position and the control portion 110 receives a piece of second utterance control information corresponding to the different manipulating member before the manipulating member corresponding to the pitch "C3" is completely depressed to the completely depressed position, the piece of first utterance control information corresponding to the pitch "D3", which is received immediately before the reception of the piece of second utterance control information, is selected. The piece of first utterance control information and the piece of second utterance control information corresponding to the pitch "D3" are used for executing a singing voice synthesis processing.

Moreover, when a plurality of utterance control information pairs each formed of the first and the second utterance control information including information representative of the same pitch which utterance control information pairs each correspond to a pitch different among utterance control information pairs are supplied from the manipulating portion 120 to the control portion 110, singing voice synthesis may be performed for each utterance control information pair (that is, synthesis of a plurality of kinds of singing voices with different pitches may be simultaneously performed in parallel). For example, when a manipulation on a manipulating member corresponding to a pitch "C3" and a manipulation on a different manipulating member corresponding to a pitch "D3" are conducted at substantially simultaneously, the singing voice syntheses executed in response to receptions of the piece of first utterance control information and the piece of second utterance control information are simultaneously performed for each of the pitch "C3" and the pitch "D3" in parallel. Therefore, the singing voice syntheses for the pitch "C3" and the pitch "D3" can be executed without faltering feeling.

(B: Modifications)

While an embodiment of the present disclosure have been described above, it is to be noted that the following modifications may be added to the embodiment:

(1) In the above-described embodiment, the first utterance control information is outputted by the manipulating portion 120 in response to the depression of the manipulating member to specify the pitch to a predetermined depth (or the detection of the user's finger touching on the manipulating member). However, the following may be performed: A sensor to detect that the user's finger has approached the manipulating member up to a distance shorter than a predetermined threshold value is used as the first sensor 121, and the first utterance control information is outputted by the manipulating portion 120 in response to the detection of the user's finger approaching the manipulating member up to the distance shorter than the predetermined threshold value by the sensor. In this case, in order to prevent the voice of the part of transition from a silence or the phoneme of the preceding portion of the lyrics to the first phoneme in the phoneme sequence represented by the phoneme sequence information from being continuously outputted without a limitation although the manipulating member is not operated in actuality, when neither the touching of the user's finger nor the depression (or the full depression) of the manipulating member is detected within a predetermined time from the output of the first utterance control information, fourth utterance control information to provide an instruction to stop the output of the voice of the transition part is outputted by the manipulating portion 120. Moreover, the following may be performed: A manipulating member to let the user provide an instruction to output the fourth utterance control information is provided on the manipulating portion 120 and the fourth utterance control information is outputted by the manipulating portion 120 in response to the detection of a manipulation on the manipulating member.

(2) In the above-described embodiment, a case is described in which the manipulating members to specify the pitch of the singing voice also assume the role of a manipulating member to let the user provide an instruction to start utterance, the first utterance control information is outputted in response to the start of a manipulation on the manipulating member (touching of the user's finger or depression to a predetermined depth) and the second utterance control information is outputted in response to the completion of the manipulation on the manipulating member (full depression of the manipulating member). However, it is to be noted that the role of outputting the second utterance control information may be assumed by a manipulating member different from the above-mentioned manipulating member (for example, a dial or a pedal for specifying the intensity or the volume of the utterance of the singing voice). Specifically, a foot-pedal-form manipulating member is provided on the manipulating portion 120 as the manipulating member to specify the intensity or the volume of the utterance of the singing voice, and the first utterance control information is outputted by the manipulating portion 120 in response to the detection of the start of a key operation on the musical note information input portion resembling a piano keyboard, whereas the second utterance control information is outputted by the manipulating portion 120 in response to the detection of the depression of the pedal-form manipulating member. Also in this mode, a voice corresponding to the transition from a silence or the phoneme of the preceding portion of the lyrics to the first phoneme in the phoneme sequence represented by the phoneme sequence information is outputted in response to the detection of the start of a key operation on the musical note information input portion resembling a piano keyboard, so that an unfaltering singing voice can be synthesized in real time with no time lag. Moreover, by adjusting the depression timing of the pedal-form manipulating member, the output timing of the voice of the part of transition from the first phoneme to the succeeding phoneme (for example, the part of transition from a consonant to a vowel) can be aligned with the timing of the musical note on the musical score, so that human singing characteristics can be accurately reproduced.

(3) While in the above-described embodiment, devices resembling an electronic keyboard instrument is used as an acquisition section for causing the singing voice synthesizing apparatus 1 to acquire the first and the second utterance control information (the musical note information input portion of the manipulating portion 120), devices resembling an electronic stringed instrument, an electronic wind instrument, an electronic percussion instrument or the like may be used as long as it resembles a MIDI-controlled electronic instrument. For example, when a device resembling an electronic stringed instrument such as an electronic guitar is used as the musical note information input portion of the manipulating portion 120, a sensor to detect that the user's finger or a pick has touched a string is provided as the first sensor 121, a sensor to detect that the user has started to pluck a string is provided as the second sensor 122, the first utterance control information is outputted in response to the detection output by the first sensor 121, and the second utterance control information is outputted in response to the detection output by the second sensor 122. In this case, the string assumes both the role of the manipulating member to let the user provide an instruction to start utterance and the role of the manipulating member to let the user specify the pitch, and further assume the role of the manipulating member to specify the velocity or the like. Also, the first utterance control information is received by the start of a manipulation (touching of the user's finger) on the manipulating member (string) to let the user provide an instruction to start voice utterance, and the second utterance control information is received by the completion of a manipulation (plucking by the user's finger or the like) on the manipulating member.

When a device resembling an electronic wind instrument is used as the musical note information input portion of the manipulating portion 120, a sensor to detect that the user's finger has touched a manipulating member resembling a piston or a key of a woodwind instrument is provided as the first sensor 121, a sensor to detect that the user has started to pipe is provided as the second sensor 122, the first utterance control information is outputted in response to the detection output by the first sensor 121, and the second utterance control information is outputted in response to the detection output by the second sensor 122. In this case, the manipulating member resembling a piston or a key of a woodwind instrument assumes the role of letting the user provide an instruction to start voice utterance and the role of letting the user specify the pitch, and a blowing mouth such as a mouthpiece assumes the role of the manipulating member to specify the velocity or the like. Also, the first utterance control information is received by the start of a manipulation (touching of the user's finger) on the manipulating member to let the user provide an instruction to start voice utterance (the manipulating member resembling a piston or a key of a woodwind instrument), and the second utterance control information is received by a manipulation (the start of piping) on the manipulating member (the blowing mouth such as a mouthpiece) different from the above-mentioned manipulating member. The second utterance control information may be outputted by the detection of the completion of the manipulation (full depression) of the manipulating member resembling a piston or a key of a woodwind instrument instead of outputting the second utterance control information by the detection of the start of piping on the blowing mouth such as a mouthpiece.

Moreover, when a device resembling an electronic percussion instrument is used as the musical note information input portion of the manipulating portion 120, a sensor to detect that a drumstick (or the user's hand or finger) has touched a beaten part is provided as the first sensor 121, a sensor to detect the completion of beating (for example, that the beating force has become maximum or that the beaten area of the beaten part has become maximum) is provided as the second sensor 122, the first utterance control information is outputted in response to the detection output by the first sensor 121, and the second utterance control information is outputted in response to the detection output by the second sensor 122. In this case, the beaten part assumes the role of the manipulating member to let the user provide an instruction to start utterance. Also, the first utterance control information is received by the start of the manipulation (touching of the user's finger or the like) on the manipulating member (beaten part) to let the user provide an instruction to start voice utterance, and the second utterance control information is received by the completion of the manipulation (that the beating force or the beaten area has become maximum) on the manipulating member. With the musical note information input portion resembling an electronic percussion instrument, there are cases where the pitch cannot be specified by an operation on the musical note information input portion. In this case, the musical note information representative of the musical notes constituting the melody of the song which is the object of singing voice synthesis (information representative of the pitch and the duration) is stored in the singing voice synthesizing apparatus 1, and the musical note information is successively read for use every time the first utterance control information is received. Moreover, it may be performed to divide the beaten part of the musical note information input portion resembling an electronic percussion instrument into a plurality of areas and associate each area with a different pitch to thereby enable pitch specification.

Moreover, the musical note information input portion is not limited to a MIDI-controlled one; it may be a general keyboard or a general touch panel to let the user input characters, symbols or numbers or may be a general input device such as a pointing device such as a mouse. When these general input devices are used as the musical note information input portion, the musical note information representative of the musical notes constituting the melody of the song which is the object of singing voice synthesis (information representative of the pitch and the duration) is stored in the singing voice synthesizing apparatus 1. Then, the first utterance control information is outputted by the manipulating portion 120 in response to the start of a manipulation on a manipulating member corresponding to a character, a symbol or a number, a touch panel, a mouse button, or the like, the second utterance control information is outputted by the manipulating portion 120 in response to the completion of the manipulation on the manipulating member, and the musical note information is successively read for use by the singing voice synthesizing apparatus 1 every time the first utterance control information is received.

It is essential only that the following mode be adopted: The first utterance control information is received in response to the start of a manipulation on the manipulating member to let the user provide an instruction to start utterance, the second utterance control information is received in response to the completion of a manipulation on the manipulating member (or a manipulation on a different manipulating member), a voice corresponding to the part of transition from a silence or the phoneme of the preceding portion of the lyrics to the first phoneme in the phoneme sequence represented by the phoneme sequence information is synthesized by use of a plurality of kinds of synthesis information in response to the acquisition of the first phoneme control information and outputted, and a voice including at least the part of transition from the first phoneme to the succeeding phoneme is synthesized by use of a plurality of kinds of synthesis information in response to the acquisition of the second utterance control information and outputted.

(4) In the above-described embodiment, a case is described in which the phoneme sequence information representative of the phoneme sequence of the portion of the lyrics uttered in time with a musical note is sequentially inputted for each musical note by an operation on the phoneme information input portion of the manipulating portion 120. However, the following may be performed: The phoneme sequence information related to the lyrics of the entire song which is the object of singing voice synthesis is previously stored in the non-volatile storage portion 162 of the singing voice synthesizing apparatus 1, the pitch and the like when each portion of the lyrics is uttered are sequentially specified for each musical note by an operation on the musical note input portion, and for each musical note, the phoneme sequence information corresponding to the musical note is read in response to the specification of the pitch and the like to synthesize a singing voice.

Moreover, in a case that voice synthesis is performed for each utterance control information pair when a plurality of utterance control information pairs each corresponding to a different pitch are supplied from the manipulating portion 120 to the control portion 110, the following may be performed: A plurality of kinds of phoneme sequence information representative of different portions of the lyrics are stored, and a singing voice of a different pitch and portion of the lyrics is synthesized by the control portion 110 for each utterance control information pair. For example, N (N is a natural number not less than 2) kinds of phoneme sequence information representative of different portions of the lyrics are sequenced and previously stored in the non-volatile storage portion 162, and when the number N of utterance control information pairs each including a different piece of pitch information is supplied from the manipulating portion 120 to the control portion 110, the processing of synthesizing the n-th ($1 \leq n \leq N$) singing voice is executed by the control portion 110 by use of the first and the second utterance control information constituting the n-th phoneme sequence information and the n-th utterance control information pair (the input order of the first utterance control information is used as the input order of the utterance control information pairs). Moreover, it may be performed to predetermine the range of the pitch so as not to overlap one another for each of the number N of pieces of phoneme sequence information and for each piece of phoneme sequence information, perform voice synthesis by use of the utterance control information pair corresponding to the pitch belonging to the pitch range corresponding to the phoneme sequence information. For example, some split points are set in the pitch direction, and the pieces of phoneme sequence information are associated one-to-one with the ranges divided by the split points.

(5) In the above-described embodiment, the manipulating portion 120 that assumes the role of the acquisition section for causing the singing voice synthesizing apparatus 1 to acquire the first and the second utterance control information and a plurality of kinds of synthesis information and the voice output portion 140 for outputting a synthetic singing voice are incorporated in the singing voice synthesizing apparatus 1. However, a mode may be adopted that either one of the manipulating portion 120 and the voice output portion 140 or both of them are connected to the external device I/F portion 150 of the singing voice synthesizing apparatus 1. In the mode that the manipulating portion 120 is connected to the singing voice synthesizing apparatus 1 through the external device I/F portion 150, the external device I/F portion 150 assumes the role of the acquisition section.

An example of the mode in which both the manipulating portion 120 and the voice output portion 140 are connected to the external device I/F portion 150 is a mode in which an Ethernet (trademark) interface is used as the external device I/F portion 150, an electric communication line such as a LAN (local area network) or the Internet is connected to this external device I/F portion 150 and the manipulating portion 120 and the voice output portion 140 are connected to this electric communication line. According to this mode, it is possible to provide so-called cloud computing type singing voice synthesis service. Specifically, the phoneme sequence information inputted by operating various manipulating members provided on the manipulating portion 120 and the first and the second utterance control information are supplied to the singing voice synthesizing apparatus through the electric communication line, and the singing voice synthesizing apparatus executes singing voice synthesis processing based on the phoneme sequence information and the first and the second utterance control information supplied through the electric communication line. In this manner, the voice data of the synthetic singing voice synthesized by the singing voice synthesizing apparatus is supplied to the voice output portion 140 through the electric communication line, and a voice corresponding to the voice data is outputted from the voice output portion 140.

(6) In the above-described embodiment, the singing voice synthesis program 162*b* for causing the control portion 110 to execute the singing voice synthesis processing noticeably exhibiting the features of the present disclosure is previously stored in the non-volatile storage portion 162 of the singing voice synthesizing apparatus 1. However, this singing voice synthesis program 162*b* may be distributed in the form of being written on a computer-readable recording medium such as a CD-ROM (compact disk-read only memory) or may be distributed by a download through an electric communication line such as the Internet. This is because by causing a general computer such as a personal computer to execute the program distributed as described above, it is possible to cause the computer to function as the singing voice synthesizing apparatus 1 of the above-described embodiment. Moreover, it is to be noted that the present disclosure may be applied to a game program of a game including real-time singing voice synthesis processing as a part thereof. Specifically, the singing voice synthesis program included in the game program may be replaced with the singing voice synthesis program 162*b*. According to this mode, the expressive power of the singing voice synthesized as the game proceeds can be improved.

(7) In the above-described embodiment, an example of application of the present disclosure to a real-time singing voice synthesizing apparatus is described. However, the object of application of the present disclosure is not limited to the real-time singing voice synthesizing apparatus. For example, the present disclosure may be applied to a voice synthesizing apparatus that synthesizes a guidance voice in a voice guidance in real time or a voice synthesizing apparatus that synthesizes a voice of reading literary work such as a novel or a poem in real time. Moreover, the object of application of the present disclosure may be a toy having a singing voice synthesis function or a voice synthesis function (a toy incorporating a singing voice synthesizing apparatus or a voice synthesizing apparatus).

Here, the above embodiments are summarized as follows.

(1) There is provided a voice synthesizing apparatus comprising:

a first receiving step of receiving first utterance control information generated by detecting a start of a manipulation on a manipulating member by a user;

a first synthesizing step of synthesizing, in response to a reception of the first utterance control information, a first voice corresponding to a first phoneme in a phoneme sequence of a voice to be synthesized to output the first voice;

a second receiving step of receiving second utterance control information generated by detecting a completion of the manipulation on the manipulating member or a manipulation on a different manipulating member; and a second synthesizing step of synthesizing, in response to a reception of the second utterance control information, a second voice including at least the first phoneme and a succeeding phoneme being subsequent to the first phoneme of the voice to be synthesized to output the second voice.

(2) For example, in the first synthesizing step, a voice corresponding to a part of transition from a silence or a preceding phoneme preceding the first phoneme to the first phoneme in the phoneme sequence of the voice to be synthesized is synthesized in response to the reception of the first utterance control information, and in the second synthesizing step, a voice including at least a part of transition from the first phoneme to the succeeding phoneme in the phoneme sequence is synthesized in response to the reception of the second utterance control information.

(3) For example, the first synthesizing step and the second synthesizing step are performed by using synthesis information including phoneme sequence information representative of the phoneme sequence of the voice to be synthesized and pitch information representative of a pitch, the manipulating member to provide an instruction to start utterance of the first voice synthesized by using the synthesis information acts as a manipulating member to let the user specify the pitch of the first voice, the first utterance control information includes the pitch information constituting part of the synthesis information and representing the pitch specified by the manipulation on the manipulating member, and in the first synthesizing step, the first voice is synthesized by using the pitch information included in the first utterance control information.

(4) For example, when successively receiving a plurality of pieces of first utterance control information each including pitch information representative of a different pitch, the first voice is synthesized by using the pitch information included in one piece selected from among the plurality of pieces of first utterance control information.

(5) For example, when successively receiving a plurality of pieces of second utterance control information each including information representative of a different velocity or volume, the second voice is synthesized by using information included in one piece selected from among the plurality of pieces of second utterance control information.

(6) For example, when receiving a plurality of utterance control information pairs each formed of the first and the second utterance control information including pitch information representative of the same pitch which utterance control information pairs each correspond to a different pitch, voice synthesis is performed for each utterance control information pair.

(7) For example, the voice synthesizing method further comprises:

outputting third utterance control information to provide an instruction to stop an output of the first voice when the reception of the second utterance control information is not detected within a predetermined time from the output of the first utterance control information.

(8) For example, the first voice is synthesized by using the pitch information included in the earliest received one piece selected from among the plurality of pieces of first utterance control information.

(9) For example, the first voice is synthesized by using the pitch information included in the last received one piece selected from among the plurality of pieces of first utterance control information.

(10) For example, the voice synthesizing method further comprises:

a third receiving step of receiving third utterance control information generated by detecting a completion of a manipulation on the manipulating member by the user, wherein the third utterance control information includes pitch information and a velocity or a volume;

a third synthesizing step of synthesizing, in response to a reception of the third utterance control information, a third voice to output the third voice; and a switching step of switching between a first operation mode and a second operation mode, wherein in the first operation mode, the first receiving step, the first synthesizing step, the second receiving step and the second synthesizing step are performed; and wherein in the second operation mode, the third receiving step and the second synthesizing step are performed.

(11) For example, a detection of the manipulation on the manipulating member by the user includes a detection of the user's finger approaching to the manipulating member.

(12) Here, there is also provided a voice synthesizing apparatus comprising:

a first receiver configured to receive first utterance control information generated by detecting a start of a manipulation on a manipulating member by a user;

a first synthesizer configured to synthesize, in response to a reception of the first utterance control information, a first voice corresponding to a first phoneme in a phoneme sequence of a voice to be synthesized to output the first voice;

a second receiver configured to receive second utterance control information generated by detecting a completion of the manipulation on the manipulating member or a manipulation on a different manipulating member; and a second synthesizer configured to synthesize, in response to a reception of the second utterance control information, a second voice including at least the first phoneme and a succeeding phoneme being subsequent to the first phoneme of the voice to be synthesized to output the second voice.

(13) For example, the processor further comprises: a first sensor configured to detect the start of the manipulation on the manipulating member by the user; and a second sensor configured to detect the completion of the manipulation on the manipulating member or the manipulation on the different manipulating member.

By the feature described in the above item (3), it is possible to synthesize an unfaltering natural voice in real time while appropriately specifying the pitch when a synthetic voice is uttered.

By the feature described in the above item (5), it is possible to synthesize an unfaltering natural voice in real time while appropriately specifying the velocity or volume when a synthetic voice is uttered in addition to the pitch.

By the feature described in the above item (6), synthetic voices with different pitches can be simultaneously synthesized in parallel.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2012-250438 filed on Nov. 14, 2012, the contents of which are incorporated herein by reference.

What is claimed is:

1. A voice synthesizing method comprising:

a first receiving step of receiving first utterance control information generated on detecting a start of a manipulation on an input device by a user, wherein the start of the manipulation is an initial interaction with the input device by the user;

a first synthesizing step of synthesizing and outputting, in accordance with a timing of the reception of the first utterance control information, a first voice including a first phoneme in a phoneme sequence of a voice to be synthesized;

a second receiving step of receiving second utterance control information generated on detecting a completion of the manipulation on the input device by the user, wherein the completion of the manipulation is a completion of the initial interaction with the input device by the user; and a second synthesizing step of synthesizing and outputting, in accordance with a timing of the reception of the second utterance control information, a second voice including a succeeding phoneme in the phoneme sequence, the succeeding phoneme being subsequent to the first phoneme in the phoneme sequence.

2. The voice synthesizing method according to claim 1, wherein the first voice comprises a part of transition from a silence or a preceding phoneme to the first phoneme and the first phoneme; and wherein the second voice comprises at least a part of transition from the first phoneme to the succeeding phoneme and the succeeding phoneme.

3. The voice synthesizing method according to claim 1, wherein the first synthesizing step and the second synthesizing step are performed with using synthesis information including phoneme sequence information representative of the phoneme sequence of the voice to be synthesized and pitch information representative of a pitch;

wherein the user manipulates the input device to provide an instruction to start utterance of the first voice synthesized with using the synthesis information, and through the manipulation the user can specify the pitch of the first voice;

wherein the first utterance control information includes the pitch information representing the pitch specified through the manipulation on the input device; and wherein in the first synthesizing step, the first voice is synthesized with using the pitch information included in the first utterance control information.

4. The voice synthesizing method according to claim 3, wherein when successively receiving a plurality of pieces of first utterance control information each including pitch information representative of a different pitch, the first voice is synthesized with using the pitch information included in one piece selected from among the plurality of pieces of first utterance control information.

5. The voice synthesizing method according to claim 3, wherein when successively receiving a plurality of pieces of second utterance control information each including information representative of a different velocity or volume, the second voice is synthesized with using the information included in one piece selected from among the plurality of pieces of second utterance control information.

6. The voice synthesizing method according to claim 3, wherein when receiving a plurality of utterance control information pairs, each of the pairs formed of the first and the second utterance control information including pitch information representative of the same pitch, each pair of the utterance control information pairs includes the pitch information representative of a different pitch from the other pairs, voice synthesis is simultaneously performed for each utterance control information pair in parallel.

7. The voice synthesizing method according to claim 1, further comprising:

outputting third utterance control information to provide an instruction to stop an output of the first voice when the reception of the second utterance control information is not detected within a predetermined time from the output of the first utterance control information.

8. The voice synthesizing method according to claim 4, wherein the first voice is synthesized with using the pitch information included in an earliest received one piece selected from among the plurality of pieces of first utterance control information.

9. The voice synthesizing method according to claim 4, wherein the first voice is synthesized with using the pitch information included in a last received one piece selected from among the plurality of pieces of first utterance control information.

10. The voice synthesizing method according to claim 1, further comprising:

a third receiving step of receiving third utterance control information generated on detecting a completion of the manipulation on the input device by the user, wherein the third utterance control information includes pitch information and a velocity or a volume;

a third synthesizing step of synthesizing and outputting, in accordance with a timing of the reception of the third utterance control information, a third voice; and a switching step of switching between a first operation mode and a second operation mode, wherein in the first operation mode, the first receiving step, the first synthesizing step, the second receiving step, and the second synthesizing step are performed; and wherein in the second operation mode, the third receiving step and the second synthesizing step are performed.

11. The voice synthesizing method according to claim 1, wherein the detection of the start of the manipulation on the input device by the user includes a detection of the user's finger approaching the input device.

12. A voice synthesizing apparatus comprising:

a first receiver configured to receive first utterance control information generated on detecting a start of a manipulation on an input device by a user, wherein the start of the manipulation is an initial interaction with the input device by the user;

a first synthesizer configured to synthesize and output, in accordance with a timing of the reception of the first utterance control information, a first voice including a first phoneme in a phoneme sequence of a voice;

a second receiver configured to receive second utterance control information generated on detecting a completion of the manipulation on the input device by the user, wherein the completion of the manipulation is a completion of the initial interaction with the input device by the user; and a second synthesizer configured to synthesize and output, in accordance with a timing of the reception of the second utterance control information, a second voice including a succeeding phoneme in the phoneme sequence, the succeeding phoneme being subsequent to the first phoneme in the phoneme sequence.

13. The voice synthesizing apparatus according to claim 12, further comprising:

a first sensor configured to detect the start of the manipulation on the input device by the user; and a second sensor configured to detect the completion of the manipulation on the input device.

14. The voice synthesizing apparatus according to claim 12, wherein the second receiver receives the second utterance control information generated on only detecting the completion of the manipulation on the input device by the user.

15. The voice synthesizing method according to claim 1, wherein when the first phoneme represents a consonant:

the first voice is synthesized and output in accordance with the timing of the reception of the first utterance control information, and the second voice is synthesized and output in accordance with the timing of the reception of the second utterance control information; and wherein when the phoneme sequence represents one vowel:

the voice including the phoneme sequence is synthesized and output in accordance with the timing of the reception of the first utterance control information, and the voice including the phoneme sequence is not synthesized and output in accordance with the timing of the reception of the second utterance control information.

16. The voice synthesizing method according to claim 1, wherein when the first phoneme represents a consonant:

the first voice is synthesized and output in accordance with the timing of the reception of the first utterance control information, and the second voice is synthesized and output in accordance with the timing of the reception of the second utterance control information; and wherein when the phoneme sequence represents one vowel:

the voice including the phoneme sequence is not synthesized and output in accordance with the timing of the reception of the first utterance control information, and the voice including the phoneme sequence is synthesized and output in accordance with the timing of the reception of the second utterance control information.

17. The voice synthesizing apparatus according to claim 12, wherein when the first phoneme represents a consonant:

the first voice is synthesized and output in accordance with the timing of the reception of the first utterance control information, and the second voice is synthesized and output in accordance with the timing of the reception of the second utterance control information; and wherein when the phoneme sequence represents one vowel:

the voice including the phoneme sequence is synthesized and output in accordance with the timing of the reception of the first utterance control information, and the voice including the phoneme sequence is not synthesized and output in accordance with the timing of the reception of the second utterance control information.

18. The voice synthesizing apparatus according to claim 12, wherein when the first phoneme represents a consonant:

the first voice is synthesized and output in accordance with the timing of the reception of the first utterance control information, and the second voice is synthesized and output in accordance with the timing of the reception of the second utterance control information; and wherein when the phoneme sequence represents one vowel:

the voice including the phoneme sequence is not synthesized and output in accordance with the timing of the reception of the first utterance control information, and the voice including the phoneme sequence is synthesized and output in accordance with the timing of the reception of the second utterance control information.

19. The voice synthesizing method according to claim 1, wherein the first phoneme represents a consonant, and the succeeding phoneme represents a vowel or a transition from the consonant to a vowel.

20. The voice synthesizing apparatus according to claim 12, wherein the first phoneme represents a consonant, and the succeeding phoneme represents a vowel or a transition from the consonant to a vowel.

21. An operating apparatus comprising:

a plurality of input devices each configured to receive a manipulation by a user;

a first sensor configured to detect a start of the manipulation conducted to one of the plurality of input devices by the user, wherein the start of the manipulation is an initial interaction with the one of the plurality of input devices by the user;

a second sensor configured to:

detect a completion of the manipulation conducted to the one of the plurality of input devices by the user, wherein the completion of the manipulation is a completion of the initial interaction with the one of the plurality of input devices by the user, and generate second utterance control information at a timing of the detection of the start of the manipulation;

a first generator configured to output first utterance control information at the timing of the detection of the start of the manipulation, the first utterance control information used for instructing a voice synthesizing apparatus to synthesize and output, in accordance with a timing of a reception of the first utterance control information, a first voice including a first phoneme in a phoneme sequence of a voice to be synthesized; and a second generator configured to output the second utterance control information at a timing of the detection of the completion of the manipulation, the second utterance control information used for instructing the voice synthesizing apparatus to synthesize and output, in accordance with a timing of a reception of the second utterance control information, a second voice including a succeeding phoneme in the phoneme sequence, and the succeeding phoneme being subsequent to the first phoneme in the phoneme sequence.

* * * * *